US010060680B2

(12) United States Patent
Klaves et al.

(10) Patent No.: US 10,060,680 B2
(45) Date of Patent: Aug. 28, 2018

(54) HEAT EXCHANGER AND METHOD OF MAKING THE SAME

(71) Applicant: Modine Manufacturing Company, Racine, WI (US)

(72) Inventors: Thomas Klaves, Burlington, WI (US); Edward Robinson, Caledonia, WI (US); Gregory Mross, Mt Pleasant, WI (US); Tony Rousseau, Racine, WI (US); Robert Barfknecht, Waterford, WI (US); George Becke, Racine, WI (US)

(73) Assignee: MODINE MANUFACTURING COMPANY, Racine, WI (US)

( * ) Notice: Subject to any disclaimer, the term of this patent is extended or adjusted under 35 U.S.C. 154(b) by 0 days.

(21) Appl. No.: 15/317,451

(22) PCT Filed: Jun. 25, 2015

(86) PCT No.: PCT/US2015/037587

§ 371 (c)(1),
(2) Date: Dec. 9, 2016

(87) PCT Pub. No.: WO2016/003754

PCT Pub. Date: Jan. 7, 2016

(65) Prior Publication Data

US 2017/0108281 A1 Apr. 20, 2017

Related U.S. Application Data

(60) Provisional application No. 62/018,947, filed on Jun. 30, 2014.

(51) Int. Cl.
*F28D 7/02* (2006.01)
*F28F 9/02* (2006.01)
(Continued)

(52) U.S. Cl.
CPC ..... *F28D 7/024* (2013.01); *F28D 21/0003* (2013.01); *F28F 1/126* (2013.01);
(Continued)

(58) Field of Classification Search
CPC ..... F28D 7/024; F28D 21/0003; F28D 2021/0064; F28F 9/001; F28F 9/18;
(Continued)

(56) References Cited

U.S. PATENT DOCUMENTS 380,787 A 4/1888 Catlin
3,978,914 A 9/1976 Phillips
(Continued)

FOREIGN PATENT DOCUMENTS

DE 102011103110 A1 11/2012

OTHER PUBLICATIONS

International Search Report and Written Opinion for Application No. PCT/US2015/037587 dated Sep. 30, 2015 (18 pages).

*Primary Examiner* — Ryan J Walters
(74) *Attorney, Agent, or Firm* — Michael Best & Friedrich LLP; Jeroen Valensa; Michael Bergnach

(57) ABSTRACT

A heat exchanger for transferring heat from a hot gas to a fluid includes two or more corrugated fin structures defining a plurality of hot gas flow channels. Each of the plurality of hot gas flow channels extends in a generally linear first direction. A fluid conduit includes an outer wall at least partially bonded to at least two of the corrugated fin structures. The fluid conduit defines a plurality of sequentially arranged flow passes for the fluid traveling therethrough. Each of the plurality of flow passes directs the fluid in a direction generally perpendicular to the first direction.

9 Claims, 8 Drawing Sheets

(51) Int. Cl.

| | |
|---|---|
| ***F28F 9/18*** | (2006.01) |
| ***F28F 9/00*** | (2006.01) |
| ***F28F 1/12*** | (2006.01) |
| ***F28D 21/00*** | (2006.01) |

(52) U.S. Cl.
CPC ..... *F28F 9/001* (2013.01); *F28F 9/0243* (2013.01); *F28F 9/18* (2013.01); *F28D 2021/0064* (2013.01); *F28F 2265/16* (2013.01); *F28F 2275/04* (2013.01)

(58) Field of Classification Search
CPC ..... F28F 9/0243; F28F 1/126; F28F 2265/16; F28F 2275/04
See application file for complete search history.

(56) References Cited

U.S. PATENT DOCUMENTS

| | | | |
|---|---|---|---|
| 4,015,567 | A | 4/1977 | Zabenskie |
| 4,253,225 | A | 3/1981 | Wright et al. |
| 4,285,396 | A | 8/1981 | Schwoerer et al. |
| 4,688,311 | A | 8/1987 | Saperstein et al. |
| 4,858,068 | A | 8/1989 | Bitller et al. |
| 4,893,672 | A | 1/1990 | Bader |
| 4,960,170 | A | 10/1990 | Carter |
| 5,542,467 | A | 8/1996 | Carpentier |
| 5,713,216 | A | 2/1998 | Erickson |
| 7,004,241 | B2 | 2/2006 | Smithey et al. |
| 7,011,150 | B2 | 3/2006 | Komatsubara et al. |
| 7,322,404 | B2 | 1/2008 | Van Decker et al. |
| 7,438,122 | B2 | 10/2008 | Hawranek |
| 8,136,582 | B2 | 3/2012 | Valensa et al. |
| 2003/0121649 | A1 | 7/2003 | Seiler et al. |
| 2004/0079522 | A1 | 4/2004 | Paulman et al. |
| 2005/0133202 | A1 | 6/2005 | Jorgensen et al. |
| 2005/0189094 | A1 | 9/2005 | Van Decker et al. |
| 2010/0282452 | A1 | 11/2010 | Diem et al. |
| 2011/0011569 | A1 | 1/2011 | Baker |
| 2011/0024037 | A1* | 2/2011 | Becnel ..... B21D 53/02 156/295 |
| 2012/0211215 | A1 | 8/2012 | Ishiguro et al. |
| 2012/0222845 | A1 | 9/2012 | Kinder et al. |
| 2013/0239571 | A1 | 9/2013 | Hartmann et al. |

* cited by examiner

HEAT EXCHANGER AND METHOD OF MAKING THE SAME

CROSS-REFERENCE TO RELATED APPLICATIONS

The present application claims priority to U.S. Provisional Patent Application No. 62/018,947, filed Jun. 30, 2014, the entire contents of which are hereby incorporated by reference.

FIELD OF THE INVENTION

The present invention relates to heat exchangers, and specifically relates to compact heat exchangers for heating and/or cooling a high-pressure fluid.

BACKGROUND

Heat exchangers are used to transfer thermal energy between two (or more) fluids while maintaining isolation between the fluids. Such devices typically operate by providing discrete channels or fluid flow paths for each of the fluids. Thermal energy from the hotter of the fluids is convectively transferred to the channels or flow paths through which that fluid is directed, is transferred (typically by thermal conduction) to the channels of flow paths through which the cooler of the fluids is directed, and is convectively transferred to that fluid.

Certain challenges are known to result when one of the fluids is at an elevated pressure. The elevated fluid pressure acting on the walls of channels through which the pressurized fluid is directed frequently mandates the use of channels that are rather small in size, in order to maintain acceptably low levels of mechanical stress. However, such small channel sizes also reduce the amount of surface area available to achieve the desired heat transfer, leading to increases in the length and/or number of such channels in order to meet the performance demands. Such increases lead to increased cost, size, and manufacturing complexity, and can be especially challenging in application where compact heat exchangers are desirable. Such applications, by way of example only, include refrigeration systems, fuel heating for combustion engines, vaporizers for fuel cell systems, Rankine cycle waste heat recovery evaporators, and others.

SUMMARY

According to some embodiments of the invention, a heat exchanger for transferring heat from a hot gas to a fluid includes a casing defining an internal volume of the heat exchanger, with a hot gas flow path extending through the casing from a hot gas inlet to a hot gas outlet. A fluid inlet and a fluid outlet are joined to the casing, and a plurality of fluid conduits extend through the internal volume between the fluid inlet and the fluid outlet. Each of the fluid conduits defines a hydraulically separate and continuous flow path between the fluid inlet and the fluid outlet.

In some embodiments, the flow paths defined by the fluid conduits are non-planar. In some such embodiments each of those flow paths is in the shape of a helix over at least a majority of the length of the flow path. In some embodiments the casing defines a longitudinal axis, and each of the non-planar flow defines a helical axis that is parallel to, and offset from, the longitudinal axis.

In some embodiments, at least the casing, the fluid inlet, the fluid outlet, and the fluid conduits are joined together in a common brazing process. In some embodiments casing is constructed of multiple parts that are joined in a common brazing operation with the fluid inlet, the fluid outlet, and the fluid conduits. In some embodiments the heat exchanger includes extended surfaces arranged along the hot gas flow path and joined to the fluid conduits.

According to another embodiment of the invention, a heat exchanger for transferring heat from a hot gas to a fluid includes two or more corrugated fin structures defining hot gas flow channels extending in a generally linear first direction, and a fluid conduit with an outer wall that is at least partially bonded to at least two of the corrugated fin structures. The fluid conduit defines a plurality of sequentially arranged flow passes for the fluid traveling through the fluid conduit. Each of the flow passes is arranged to direct the fluid in a direction that is generally perpendicular to the first direction. In some such embodiments the flow passes are oriented at an angle of inclination to the first direction that is no more than two degrees.

In some embodiments the heat exchanger includes a first fin structure arranged between a second and a third fin structure. Sequential flow passes are alternatingly arranged between the first and second fin structures, and the first and third fin structures. In other embodiments the heat exchanger includes a first corrugated fin structure formed into an annular shape bounded by a first inner diameter and a first outer diameter, and a second corrugated fin structure formed into an annular shape bounded by a second inner diameter and a second outer diameter, with the second outer diameter being smaller than the first inner diameter. The sequentially arranged flow passes are arranged between the second outer diameter and the first inner diameter. In some such embodiments the fluid conduit is one of several fluid conduits providing hydraulically parallel circuits for the fluid, and each one has an outer wall joined to the fin structures. In some embodiments each of the fluid conduits defines a helical flow path.

According to another embodiment of the invention, a fluid connection for a heat exchanger includes a connector body with a brazeable outer surface, a fluid manifold located within the connector body, and an externally accessible port connection fluidly coupled to the manifold. Flow conduit access channels extend between the outer surface of the connector and the manifold, and a braze alloy chamber at least partially intersects each of the access channels between the outer surface and the manifold.

According to another embodiment of the invention, a method of making a heat exchanger includes arranging flow conduits within a heat exchanger casing, extending an end of each conduit through an aperture in the wall of the casing, inserting the ends into a connector body, and, in a common brazing operation, joining the flow conduits to the connector body and joining the connector body to the casing. In some embodiments the method includes performing a leak test on the joints between the fluid conduits and the connector body after brazing and, if a leak path is found, placing additional braze paste into the braze alloy chamber and re-brazing the heat exchanger.

DETAILED DESCRIPTION

Before any embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
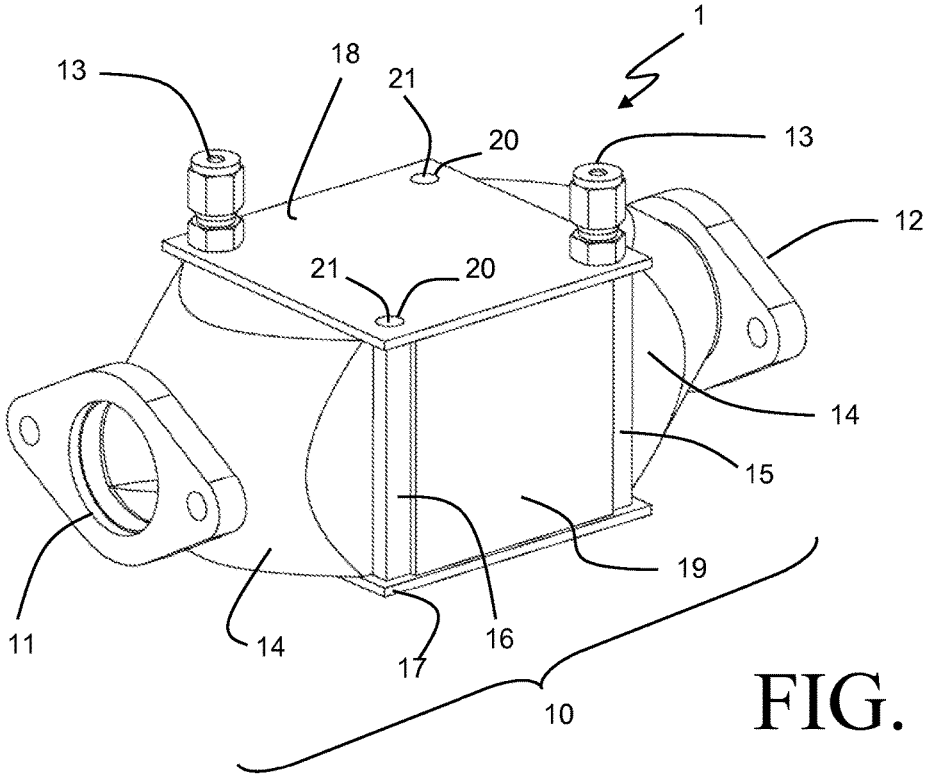
FIG. 1 is a perspective view of a heat exchanger according to an embodiment of the invention.
Figure 2:
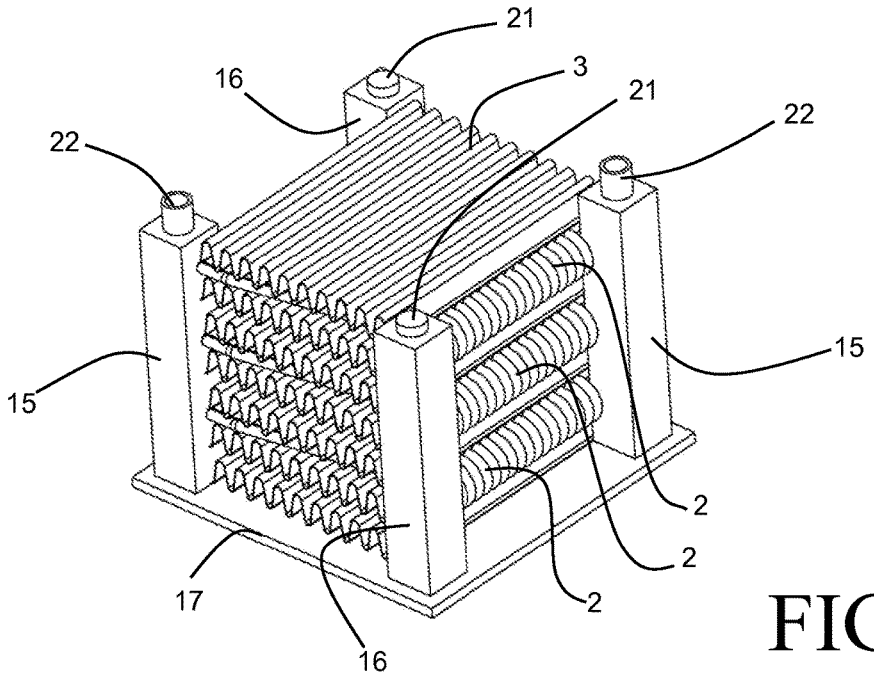
FIG. 2 is a perspective view showing select portions of the heat exchanger of FIG. 1.

A heat exchanger 1 according to one embodiment of the invention is illustrated in FIGS. 1-3. The heat exchanger 1 is configured to enable the transfer of thermal energy from a hot gas to a fluid. In some preferable embodiments the fluid enters the heat exchanger 1 as a pressurized liquid and is vaporized or, in some cases, partially vaporized as it passes through the heat exchanger 1 by heat received from the hot gas concurrently passing through the heat exchanger 1. In other embodiments the fluid enters the heat exchanger 1 as a pressurized liquid and exits the heat exchanger 1 as a heated liquid. In still other embodiments the fluid enters the heat exchanger 1 as a low pressure liquid or as a gas.

The heat exchanger 1 includes a casing 10 that bounds an internal volume of the heat exchanger 1. A hot gas inlet 11 and a hot gas outlet 12 are provided in the casing 10, and a hot gas flow path extends through the heat exchanger 1 between the hot gas inlet 11 and the hot gas outlet 12. In the embodiment of FIG. 1, the hot gas inlet 11 and the hot gas outlet 12 are shown as being at flange mounts arranged at opposite ends of the casing 10. However, it should be appreciated that other arrangements of the hot gas inlet and outlet may be equally suitable or more suitable, depending upon the application wherein the heat exchanger 1 is used.

The exemplary casing 10 is constructed of several discrete pieces that are joined together to define the internal volume of the heat exchanger 1. Inlet and outlet diffusers 14 join the inlet 11 and the outlet 12 to a substantially rectangular center portion of the casing 10 wherein the heat transfer between the hot gas and the fluid occurs. The substantially rectangular center portion of the casing 10 is constructed of a top plate 18, a bottom plate 17, side plates 19 (only one is visible in FIG. 1, but it should be understood that a similar side plate 19 is located on the opposite side of the heat exchanger 1), and corner posts 15, 16. Two fluid inlet/outlet ports 13 are joined to the casing 10 to allow for the fluid to enter and exit the heat exchanger 1, one of the inlet/outlet ports 13 functioning as an inlet and the other as an outlet.

Figure 3A:
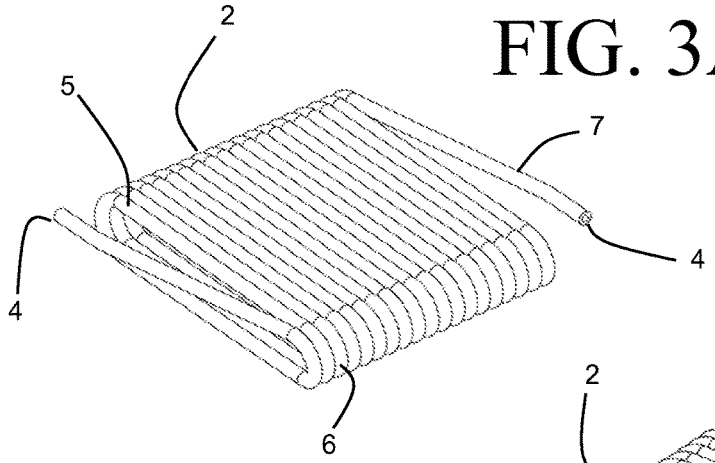
FIGS. 3A, 3B and 3C are perspective views showing the heat exchanger of FIGS. 1-2 in progressive stages of assembly.

FIG. 2 illustrates the heat exchanger 1 with certain portions of the casing removed in order to facilitate the description of internal details of the heat exchanger 1. Certain aspects of the illustrated embodiment will now be explained with reference to that figure, as well as with reference to FIGS. 3A-C depicting the heat exchanger 1 at various stages of assembly and construction.

The fluid to be heated by the hot gas is conveyed through the heat exchanger 1 by way of several fluid conduits 2 that extend through the internal volume of the casing 10. Three such fluid conduits 2 are shown in the embodiment of FIG. 2, but it should be understood that the number of fluid conduits 2 can be increased or decreased depending upon the needs of the application. An individual one of the fluid conduits 2 is shown in FIG. 3A, and is characterized by a continuous conduit wall 7 extending between spaced apart ends 4 and defining a non-planar flow path for the fluid passing through the conduit. The conduit wall 7 of the exemplary embodiment has a cross-section that is of an annular shape in order to provide a design well-suited to elevated pressure operation, but it should be understood that other cross-sectional shapes might alternatively be employed. Each flow conduit 2 defines a plurality of flow passes 5 arranged to allow the fluid to flow therethrough in serial fashion. The flow passes 5 are alternatingly arranged in two spaced apart parallel planes, with arcuately shaped bend sections 6 joining successive flow passes 2, thereby creating the non-planar flow path.

Corrugated fin structures 3 are additionally provided in the heat exchanger 1, and are joined to the fluid conduits 2 for both structural stability and improved heat transfer. Each of the corrugated fin structures 3 includes alternating crests and troughs joined by flanks, and can be constructed by forming a continuous sheet of metal through a fin rolling process. Although not shown, surface enhancement features such as louvers, lances, bumps, and the like can optionally be provided on the flanks of the corrugated fin structures to further improve heat transfer. Each of the corrugated fin structures defines a series of hot gas flow channels 8 extending in a longitudinal direction of the heat exchanger 1.

Figure 3B:
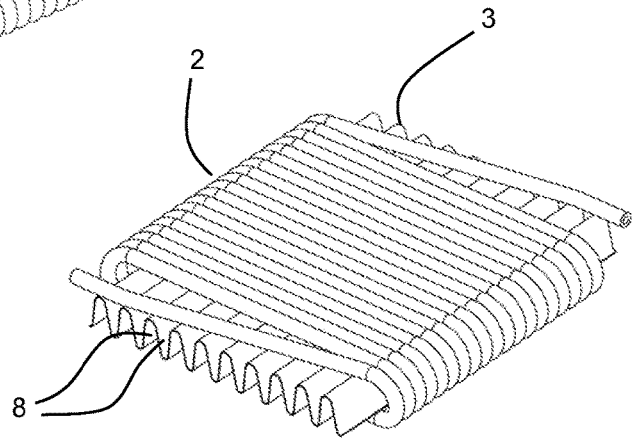
Figure 3C:
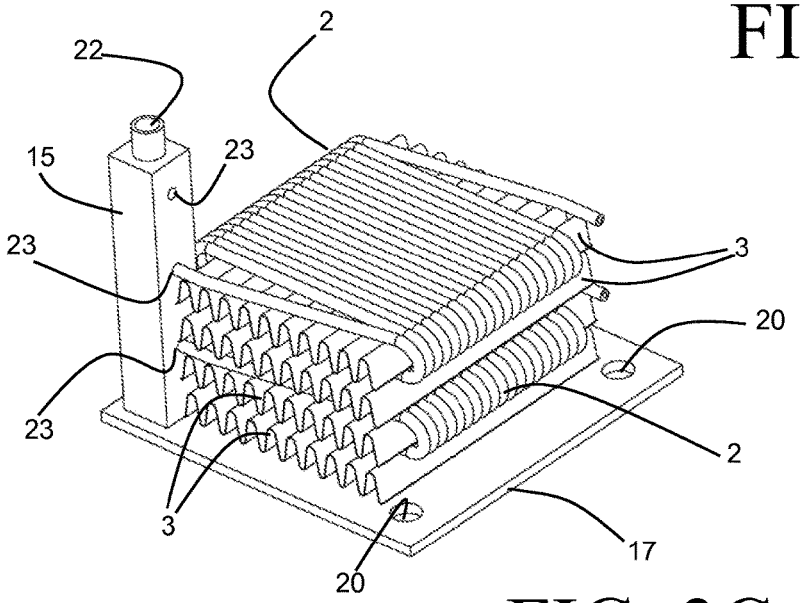

The spacing between those ones of the flow passes 5 of a given fluid conduit 2 arranged in one common plane, and those ones of the flow passes 5 of that fluid conduit 2 arranged in the other common plane, can be optimized to allow for the insertion of one of the corrugated fin structures 3 within that spacing, with the outer wall 7 of the fluid conduit 2 touching or almost touching both the crests and troughs of the corrugated fin structure 3, as shown in FIG. 3B. Such flow conduit and corrugated fin structure combinations can be arranged into a stack, with additional corrugated fin structures 3 arranged between adjacent ones of the combinations, as well as above and below the stack. The entire stack can be joined together to form a monolithic heat exchanger core by, for example, brazing. As a result of such joining, the outer wall 7 of each flow pass 5 is joined to the crests of one corrugated fin structure 3 and the troughs of another. Generally speaking, where there are N fluid flow conduits in a heat exchanger according to such an embodiment of the invention, there are (2N+1) corrugated fin structures.

The corner posts 15 and 16 are spaced apart so as to substantially block the bypass of hot gas around the hot gas flow channels 8, as well as to provide a space for the bend sections 6 of the fluid conduits 2. Solid corner posts 16 are arranged at two of the opposing corners of the core, while corner posts 15 containing a fluid manifold (not shown) are arranged at the other two opposing corners. Flow conduit connection holes 23 corresponding to the ends 4 of the fluid conduits 2 are provided in each of the corner post 15, and the ends 4 of the fluid conduits 2 are received therein and are joined to the corner posts 15 in order to provide sealed flow channels for the fluid through the internal volume of the heat exchanger 1.

Alignment apertures 20 are provided in the top plate 18 and the bottom plate 17 in order to allow for ease of assembly of the heat exchanger 1. The apertures 20 are sized and located to correspond to protrusions 21 and 22 provided at ends of the corner posts 15 and 16. Hollow protrusions 22 are provided at one end of each of the corner posts 15, that one end corresponding to the fluid port 13 for that corner post 15 (the top plate 18 end in the embodiment of FIG. 1). Solid protrusions 21 are provided at the opposing end of the corner posts 15, and at either ends of the corner posts 16. While the solid protrusions 21 need not extend beyond the surface of the top plate 18 or the bottom plate 17, it can be preferable for the hollow protrusions 22 to be longer in order to facilitate the assembly of the port 13 to that protrusion 22. The hollow protrusions 22 allow for fluid communication between the manifold located within the corner post 15 and the fluid port 13.

In some preferable embodiments, at least that portion of the heat exchanger 1 shown in FIG. 2 is joined together in a common brazing operation. Generally speaking, a brazing operation typically includes heating assembled metal components to a temperature that is near to, but less than, the melting temperature of the metal. A braze alloy with a lower melting temperature than the base metal, having been applied to the assembly prior to such heating in those areas where joints between the various components are desired, is caused to melt at the elevated temperature and flows to wet the metal surfaces at the joint locations. Upon cooling of the assembly, the liquefied braze alloy solidifies, creating metallurgical joints at those wetted locations. Various braze alloy compositions are known for use with different base metals such as steels, aluminum, copper, and alloys of the same. The braze alloy can be provided in various forms, for example as a clad layer on one or more of the parts, as a paste, as a spray, as a separate thin sheet, or in some other form, again varying with the base metal to be brazed. As used herein, the term "common brazing operation" means that joints between the indicated components are made within the same brazing operation.

In at least some embodiments, the heat exchanger 1 is constructed of austenitic stainless steel material and is brazed using a Nickel-Chromium brazing alloy. Very thin sheets of such braze alloy are assembled between the fluid conduit wall 7 and the crests or troughs of the corrugated fin structures 3. Braze alloy in a paste form is applied at the flow conduit connection holes 23 and at the alignment protrusions 21 extending through the alignment apertures 20 of the bottom plate 17. Upon heating of the assembly to the brazing temperature, the braze alloy reflows to create braze joints as previously described. The braze alloy provided between the fluid conduits 2 and the corrugated fin structures 3 flows by capillary action to additionally form joints between adjacent passes 5 of the fluid conduits 2, providing a more rigid and robust structure. Additional components of the heat exchanger 1 can be assembled after brazing. For example, the top plate 18, side plates 19, and diffusers 14 can be welded into place. The fluid inlet and outlet fittings 13 can be provided as two-part fittings, with one part welded in place to the top plate 18 and the other part joined by mechanical threads. In some embodiments at least some of these additional parts can, however, be joined in the brazing operation.

Figure 4:
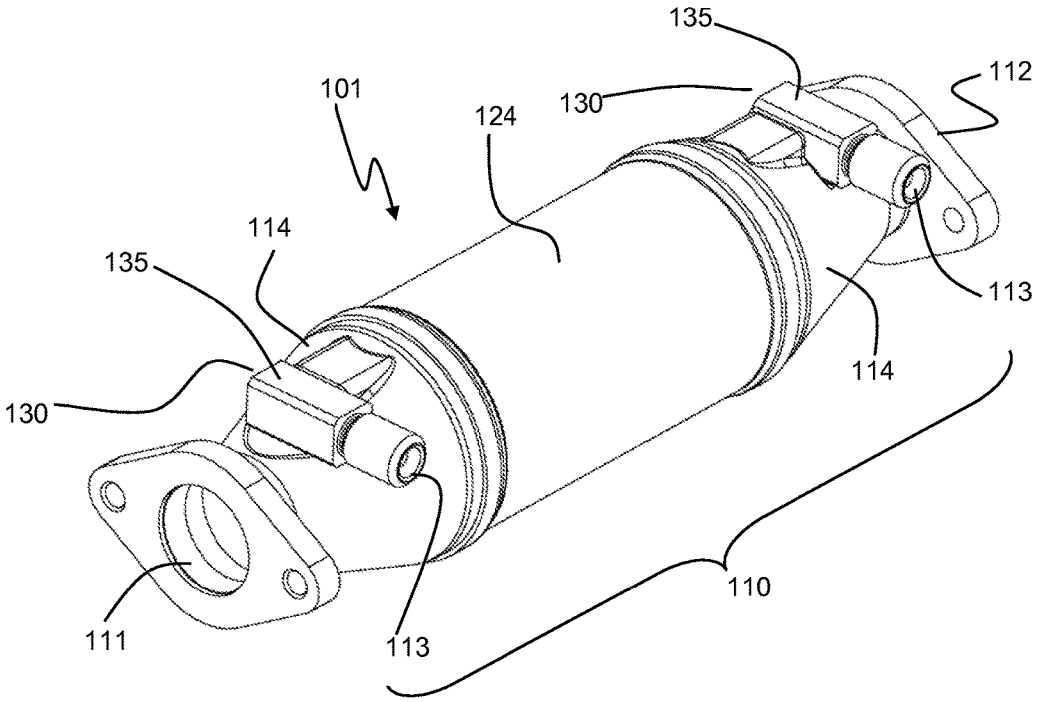
FIG. 4 is a perspective view of a heat exchanger according to another embodiment of the invention.

A heat exchanger 101 according to another embodiment of the invention is depicted in FIG. 4. The heat exchanger 101 provides certain advantages over the heat exchanger 1 in that it is more amenable to joining all of the parts in a common brazing operation. The heat exchanger 101 again includes a casing 110 defining an internal volume therein for the hot gas to pass through, with a hot gas inlet 111 arranged at one end of the casing 110 and a hot gas outlet 112 arranged at an opposing end of the casing 110. In certain embodiments (for example, when it is desirable for the hot gas to traverse an even number of passes through the heat exchanger) the hot gas inlet 111 and hot gas outlet 112 can be arranged at a common end of the heat exchanger. In still other embodiments the hot gas inlet and/or outlet are arranged at a location on the casing 110 other than an end.

The heat exchanger 101 further includes two ports 113 joined to the casing 110. A fluid connection is provided between the ports 113 as will be described in more detail later, so that one of the ports 113 can serve as a fluid inlet and the other of the ports 113 can serve as a fluid outlet. Depending upon the requirements of the application, the heat exchanger 101 can be operated in a counter-flow mode of operation by having that one of the fluid ports 113 located nearest to the hot gas outlet 112 serve as the fluid inlet, or in a concurrent-flow operation by having that one of the fluid ports 113 located nearest to the hot gas inlet 111 serve as the fluid inlet.

The casing 110 of the heat exchanger 101 101 includes a centrally located casing cylinder 124 joined to diffusers 114 at either end. Fluid connections 130 are joined to the diffusers 114 in order to provide the fluid ports 113.

Figure 5:
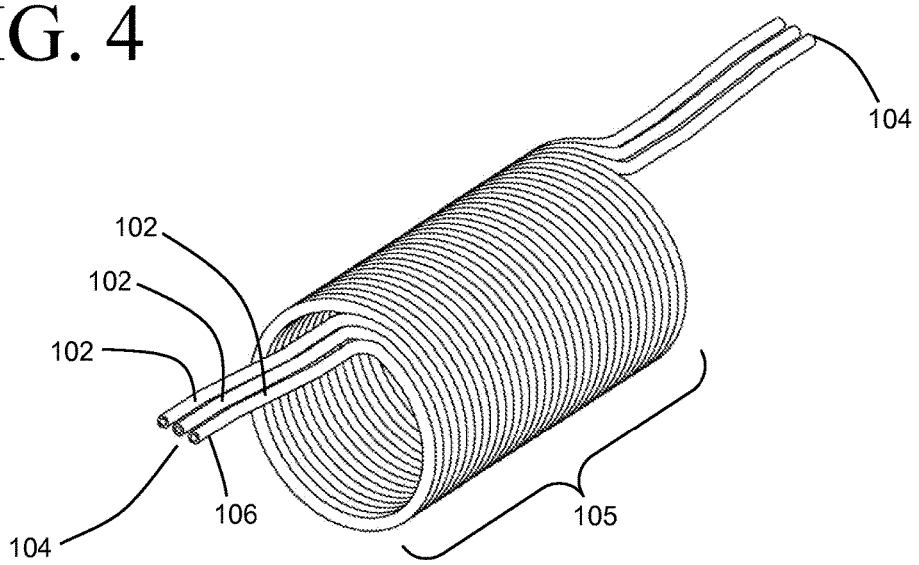
FIG. 5 is a perspective view showing select portions of the heat exchanger of FIG. 5.

Fluid conduits 102 extend between the fluid connections 130 to provide a plurality of fluid flow paths through the heat exchanger 101 for a fluid to be heated by the hot gas passing therethrough. As best seen in FIG. 5, the fluid conduits 102 again define non-planar flow paths for the fluid through the internal volume of the casing 110. In the exemplary embodiment three such fluid conduits 102 are provided, but it should be understood that more or fewer such fluid conduits 102 can be used as determined by the needs of the application.

The multiple flow conduits 102 are wound together into a cylindrical shape, so that each of the flow conduits 102 defines a helical flow path through a substantial portion of the casing cylinder 124. In so doing, each complete 360° convolution of a fluid conduit 102 defines a flow pass 105 for the fluid oriented substantially in cross-flow to the hot gas traveling through the heat exchanger 101. In other words, as the hot gas flow is traveling in a longitudinal direction generally parallel to the axis of the casing cylinder 124, the fluid traversing any flow pass 105 is traveling in a direction that is always generally perpendicular to that longitudinal direction.

In many applications, particularly those wherein the fluid traveling along the fluid conduits 102 is at an elevated pressure, it is desirable to have a flow channel that is small in size, thereby minimizing the structural loads imposed on the fluid conduit 102 by the fluid pressure. Such structural loading can be further minimized by providing flow channels that are circular in cross-section, so that the tube wall 106 is an annular shape in cross-section. Whether the flow channel is circular in cross-section or not, the size of the channel can be quantified by its hydraulic diameter, calculated as four times the flow area divided by the wetted perimeter, and having units of length. For a circular channel the hydraulic diameter is equal to the actual diameter, whereas for non-circular channels the hydraulic diameter is the diameter of a circular channel that exhibits an equivalent ratio of flow area to wetted perimeter. In some preferable embodiments of the invention the fluid conduits 102 have a hydraulic diameter that is no greater than one millimeter.

However, oftentimes in conflict with the desire to minimize the size of the channels for pressure resistance purposes is the desire to maximize the surface area of the channel wall in order to facilitate the transfer of heat to the fluid passing through the channel. As the channel size is reduced, maintaining channel surface area requires that the length of the channel be increased. It can be problematic, though, to increase substantially the channel length within a fixed volume. The non-planar fluid conduits of the heat exchanger 101 provide a solution to that problem by enabling flow channels of rather small cross-section, but substantial length. Each flow pass 105 occupies only a small portion of the length of the heat exchanger 101 in the longitudinal direction, and many such flow channels can be provided in series with one another for each of the flow conduits 102 in order to enable the requisite long channel length. Furthermore, adjacent ones of the flow channels 105 can be placed directly alongside one another for compactness without blocking the flow of the hot gas over the surfaces of the fluid conduit walls 106.

Figure 7:
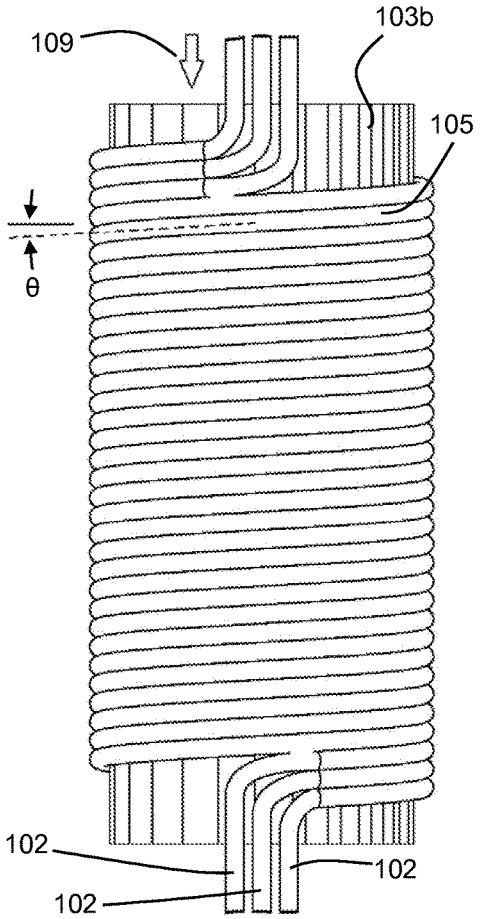
FIG. 7 is a plan view showing select portions of the heat exchanger of FIG. 5.

The design of the heat exchanger 101 provides flexibility in adjusting the pressure drop by allowing for the total number of flow passes 105 (e.g. the total length available divided by the outer dimension of the fluid conduit wall 106) to be distributed amongst multiple fluid conduits 102 without impacting the total surface area available for heat transfer. Increasing the number of such fluid conduits 102 decreases both the length of each conduit and the fluid velocity in the conduits, and will therefore lead to a dramatic reduction in the pressure drop incurred. The maximum number of flow passes 105 can be attained by having adjacent ones of the flow passes in direct contact with one another, as best seen in FIG. 7. This compact arrangement allows for each of the flow passes 105 to be arranged in substantially cross-flow orientation to the flow of exhaust gas, which is traveling in the direction indicated by the arrow 109 (i.e. in the longitudinal direction of the heat exchanger 101). As the fluid traverses one of the flow passes 105, the instantaneous direction of fluid flow through the conduit 102 is approximately perpendicular to the direction of the hot gas flow, although it will vary slightly from a truly perpendicular arrangement due to the angle of inclination, θ. In some preferable embodiments the angle of inclination θ is no greater than two degrees.

One potential shortcoming of the wound together flow conduits 102 as depicted in FIG. 5 is that a portion of the outer surfaces of the tube walls 106 is not available to the flow of hot gas for convective heat transfer, that portion of the tube wall instead being in intimate contact with the tube wall 106 of another flow conduit 102. In order to address the potentially deleterious effect on heat transfer that could result, it can be advantageous to provide a corrugated fin structure 103*a* within an annulus located radially outward of the cylinder formed by the fluid conduits 102, and a corrugated fin structure 103*b* within an annulus located radially inward of that cylinder. The corrugated fin structures 103*a,b* can initially be formed as planar structures similar to the corrugated fin structures 3 of the embodiment of FIG. 2, and can subsequently be formed into an annular shape. Crests of the corrugated fin structures 103*b*, and troughs of the corrugated fin structure 103*a*, can be bonded to the tube walls 106 in order to provide decreased resistance to heat transfer so that the corrugated fin structures 103*a*, b can effectively operate as extended heat transfer surfaces for the hot gas. As before, each of the corrugated fin structures defines a series of hot gas flow channels 108 extending in a longitudinal direction (i.e. the direction indicated by the arrow 109) of the heat exchanger 101.

In one embodiment of the invention, the components of the heat exchanger 101 are assembled and joined to form a completed heat exchanger 101 in one brazing operation. This common brazing operation creates the requisite joint between the components of the casing 110, between the fluid conduits 102 and the fluid connections 130, and between the fluid conduits 102 and the corrugated fin structures 103*a,b* (if present).

To assemble the heat exchanger 101, the corrugated fin structure 103*a* is formed into an annular shape and inserted into the casing cylinder 124. Resizing of the corrugated fin structure 103*a* can optionally be performed after the insertion by mechanically re-sizing the internal diameter of the annular shape with a cylinder having a slight interference fit with the corrugated fin structure 103*a*. Such a re-sizing operation creates a more uniform internal diameter of the corrugated fin structure 103*a*, as well as slightly flattening the troughs of the corrugations to increase the surface area available for joints between the corrugated fin structure 103*a* and the fluid conduits 102.

The fluid conduits 102, having been wound into the cylindrical shape shown in FIG. 5, are inserted into the center of the corrugated fin structure 103*a*. Braze alloy can be placed between the corrugated fin structure 103*a* and the fluid conduits 102 as a thin sheet inserted prior to, or concomitant with, the insertion of the fluid conduits 102. Alternatively, the braze alloy can be applied as a spray or a paste onto the troughs of the corrugated fin structure 103*a*, or onto the outer surfaces of the tube walls 106, or both. In some embodiments having compatible metal alloys, the braze alloy can be applied as a clad layer onto some of the metal surfaces.

The corrugated fin structure 103*b* is formed into an annular shape and is inserted into the center of the cylinder formed by the fluid conduits 102. Braze alloy can be inserted between the crests of the corrugated fin structure 103*b* and the fluid conduits 102 in a similar manner as was described for the corrugated fin structure 103*a*. A central core 128 is inserted into the center of the corrugated fin structure 103*b*, and can be sized to have a slight interference fit with the corrugated fin structure 103*b* so that the crests of the corrugated fin structure 103*b* are pressed tightly against the fluid conduits 102. The central core 128 can be a solid cylinder, or a hollow cylinder with caps on one or both ends.

In some embodiments it can be preferable to select the specific alloy compositions of the various components to ensure better bonding between components during brazing. The casing cylinder 124, for example, can be constructed of an alloy having a slightly lower coefficient of thermal expansion than that of the internal components. As the assembly is heated to the brazing temperature, the internal components will thermally expand by a greater percentage than will the casing cylinder 124, thereby ensuring that tight contact is maintained between the components intended to be joined by the braze alloy. As one non-limiting example, the casing cylinder 124 can be constructed of grade 409 ferritic stainless steel while the internal components (e.g. the corrugated fin structures 103*a* and 103*b*, the fluid conduits 102, and the center core 128) are constructed of grade 316 stainless steel, which has a coefficient of thermal expansion that is approximately one and a half times that of grade 409 stainless steel.

Connection of the ends 104 of the fluid conduits 102 to the fluid connectors 130 in a brazing operation can be especially problematic. The small internal size of the fluid conduits 102 makes them especially prone to clogging by braze alloy when the braze alloy is liquefied at braze temperature. In some embodiments of the invention, the fluid connectors 130 have been designed with specific features to prevent such clogging and allow for the fluid conduits 102 to be economically joined to the fluid connectors 130 in a common brazing operation with the other components to be joined.

Figure 8:
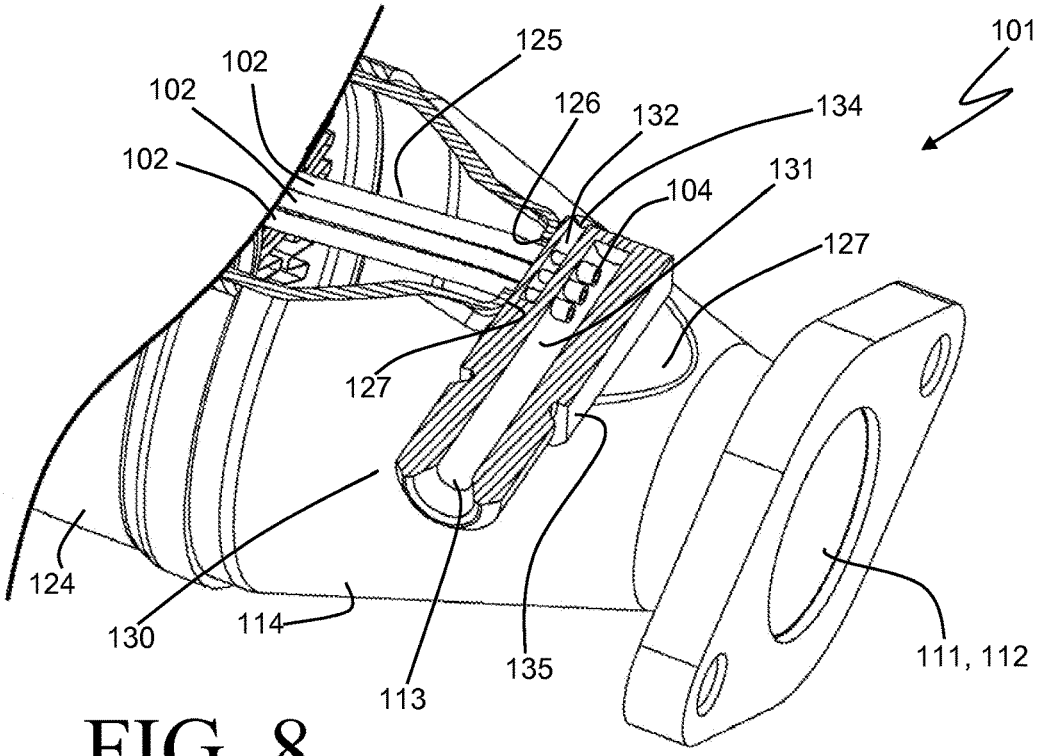
FIG. 8 is a partial, sectioned, perspective view of the heat exchanger of FIG. 5.
Figure 9:
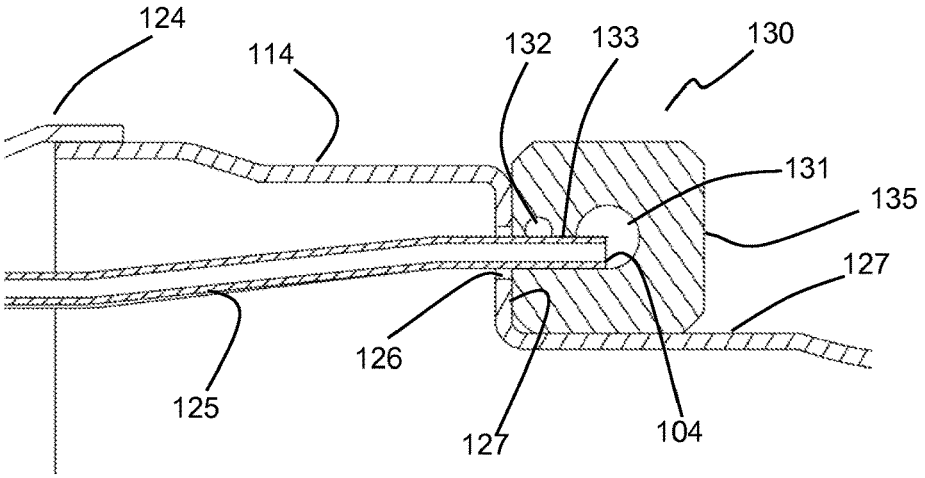
FIG. 9 is partial section view of the heat exchanger of FIG. 5.

With specific reference to FIGS. 8 and 9, the fluid connections 130 as depicted include a connector body 135 having a brazeable outer surface. The connector body 135 can, for example, be constructed of a similar alloy as the rest of the casing 110. Within the connector body 135 is located a fluid manifold 131 in connection with the fluid port 113 that functions as either the inlet or the outlet for the fluid flow. The fluid manifold serves either to distribute the fluid to the plurality of fluid conduits 102 (in the case where the fluid connector 130 provides the fluid inlet port) or to receive the fluid from the plurality of fluid conduits 102 (in the case where the fluid connector 130 provides the fluid outlet port). Multiple flow conduit access channels 133, each corresponding to one of the plurality of fluid conduits 102, extend from an outer surface of the connector body 135 to the fluid manifold 131. The flow conduit access channels 133 are sized to be slightly larger than the outer dimensions of the tube walls 106 so that a braze alloy can flow by capillary action during brazing to fill the clearance void, thereby joining the tube walls 106 to the connector body 135. In some preferable embodiments both the tube walls 106 of the fluid conduits 102 and the flow conduit access channels 133 are circular in cross-section for ease of assembly and to promote a uniform braze joint.

A braze alloy chamber 132 is further provided within the connector body 135. The braze alloy chamber partially intersects each of the flow conduit access channels 133 at a location between the outer surface of the connector body 135 and the manifold 131. An externally accessible opening 134 of the braze alloy chamber 132 is provided on an external surface of the connector body 135. While the exemplary embodiment places the opening 134 on a different external surface of the connector body 135 than that surface which is intersected by the flow conduit access channels 133, in some alternative embodiments they can be the same external surface. It is preferable, however, that the opening 134 of the braze alloy chamber 132 be accessible after assembly of the connector 130 to the casing 110.

During assembly of the heat exchanger 101, and preferably prior to a common brazing operation for the components of the heat exchanger 101, the diffusers 114 are assembled to the casing cylinder 124. As best seen in FIG. 9, the casing cylinder 124 has flared ends sized to receive an end of a diffuser 114. Preferably some clearance is provided between the flared end and the diffuser 114 so that braze alloy (which can, for example, be applied in paste form at the joint) can wick by capillary action into that clearance gap to provide a metallurgical joint between the components. In assembling the diffuser 114 to the cylinder 124, ends 104 of the fluid conduits 102 can be made to pass through an aperture 126 of the casing 110, provided in this case within the diffuser 114.

The fluid connector 130 can be assembled to the casing 110 by inserting the ends 104 of the fluid conduits 102, having been made accessible by passing through the aperture 126 so as to be external to the casing 110, into the corresponding flow conduit access channels 133 so that the ends 104 reside within the manifold 131. Coincident therewith, outer surfaces of the connector body 135 are disposed near to or against corresponding surfaces 127 of the casing 110. The corresponding surfaces 127 of the exemplary embodiment are provided by a depression formed into the diffuser 114. Braze alloy is applied between those surfaces so that the connector 130 can be joined to the casing 110 in the common brazing operation, thereby additionally closing off the aperture 126 from the external environment to prevent leakage of the hot gas through the aperture 126 during operation.

Prior to the common brazing operation, a braze alloy paste is dispensed into the braze alloy chamber 132 through the opening 134. The braze alloy paste is preferably dispensed after assembly of the fluid conduits 102 to the fluid connector 130, in order to avoid clogging of the open ends 104 with paste during the insertion of the fluid conduits 102 into the fluid connector 130. As best seen in FIG. 9, the braze alloy chamber 132 is located so as to prevent it from being blocked by the inserted fluid conduits 102. The flow conduit access channels 133 are arranged so that the centroidal axes of all such channels 133 are aligned in a plane. The braze alloy chamber 132 extends parallel to, but offset from, that plane to ensure that the chamber 132 is not completely blocked along the entirety of its length, even though the chamber 132 is smaller in cross-section than the flow conduit access channels 133. This enables the braze alloy chamber 132 to be kept to a small enough internal volume so as to avoid an excess of braze alloy, which could otherwise result in clogging of the fluid conduits 102.

In some embodiments of the invention, the heat exchanger 101 is fabricated using a single common brazing operation as previously described, and after brazing the heat exchanger 101 is tested for leaks along the fluid flow path between the inlet and outlet ports 113. As the only joints created along that fluid flow path are those between the fluid connections 130 and the fluid conduits 102, in the event of a leak path being indicated by the leak test, the heat exchanger 101 can be repaired by introducing additional braze alloy paste (for example, a braze alloy paste having a slightly lower melting point than the braze alloy paste originally used) into the braze alloy chambers 132 and re-brazing the heat exchanger 101. In the case where no leak path is indicated during the leak testing, the braze alloy manifold opening 134 can be permanently sealed (by, for example, welding) to further seal the fluid flow path against eventual leakage. Such a process can be especially beneficial when the fluid intended to be circulated along that flow path presents a danger if leakage occurs.

Figure 10:
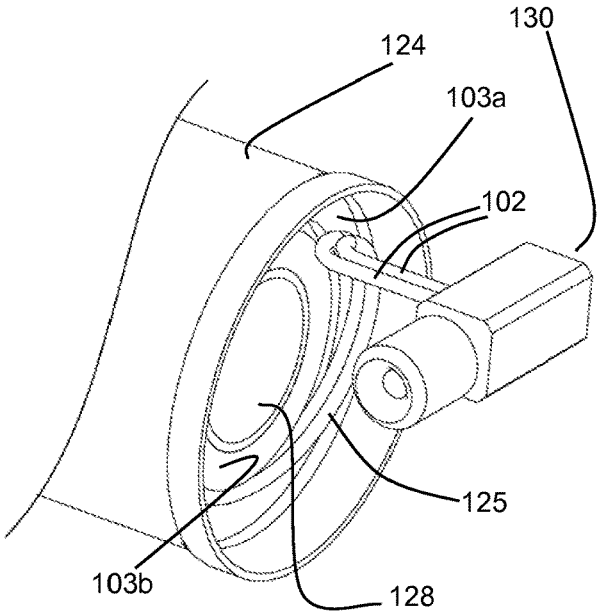
FIG. 10 is a partial perspective view showing select portions of the heat exchanger of FIG. 5.

In some preferable embodiments of the invention, the fluid conduits 102 of the heat exchanger 101 are provided with a compliant portion 125 between the flow passes 105 and one or both of the fluid connections 130, as shown in FIG. 10. The compliant portion 125 can be provided by having the length of the fluid conduits 102 extending between the corrugated fin structures 103*a,b* and the fluid connection 130 be substantially greater than the actual distance therebetween. In some embodiments the compliant portion 125 can be provided as an additional extension of the helical profile beyond the region where the fluid conduits 102 are bonded to the corrugated fin structures. Such a compliant portion 125 can prevent excessive stresses on the braze joints between the fluid conduits 102 and the fluid connector 130 as a result of thermal cycling events, for example.

Figure 11:
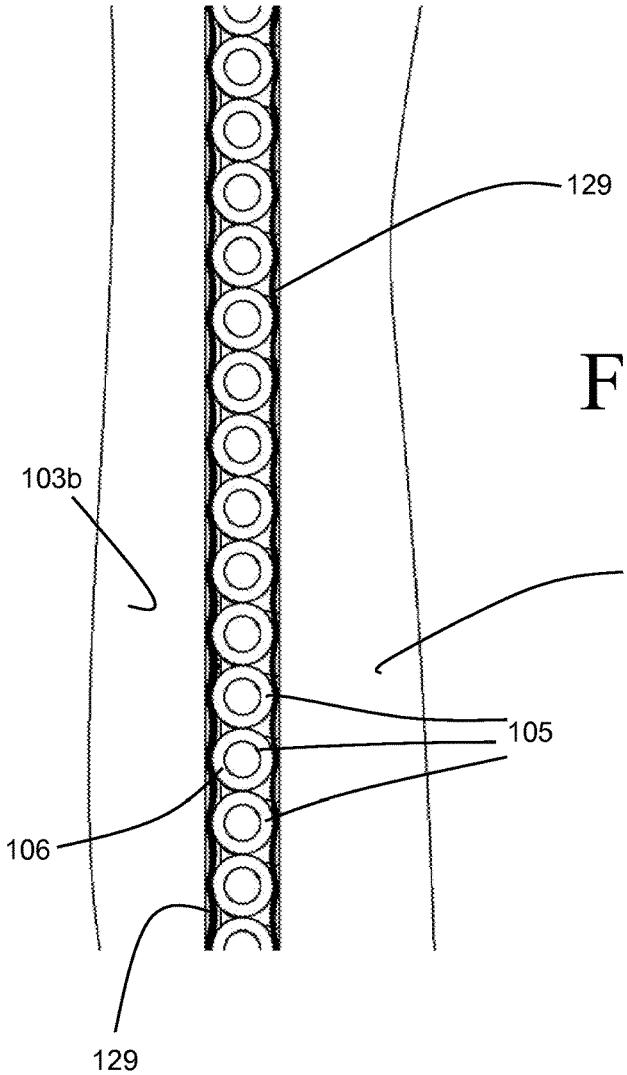
FIG. 11 is another partial section view of the heat exchanger of FIG. 5.

In some embodiments of the invention, the integrity of the braze joints between the corrugated fin structures 103*a,b* and the tube walls 106 can be improved by the addition of thin metallic shims 129 arranged between the tube walls 106 and the corrugated fin structures 103*a,b* as shown in FIG. 11. The presence of the shims 129 can prevent the loss of braze alloy to the crevices between adjacent passes 105 of the fluid conduits 102, which could result in insufficient braze alloy remaining for the bonding of the corrugated fin structures 103*a,b* and the tube walls 106. The metallic shims 129 can be formed into a cylindrical shape prior to insertion, and braze alloy can be provided on either side of each shim 129 as a separate sheet, spray, coating, clad layer, or other form. During the brazing operation, the corrugated fin structures 103*a,b* and the tube walls 106 and the metallic shims 129 are brazed together to form a bonded unit. As a further benefit, the metallic shims can partially conform to the surfaces of the tube wall 106, thereby reducing the thermal resistance through the bonded joint by providing additional lateral heat spreading.

Figure 13:
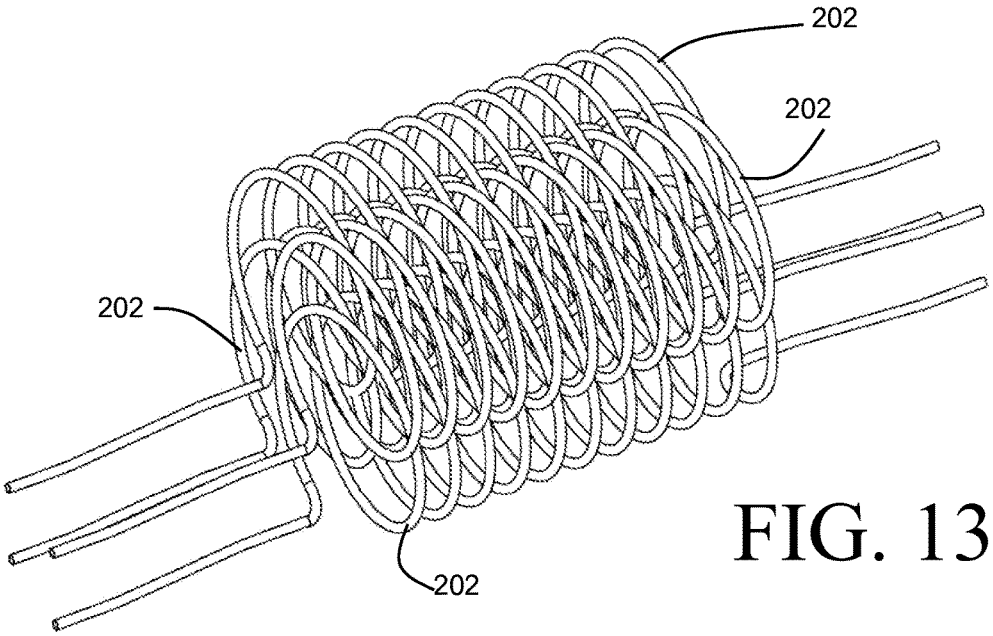
FIG. 13 is a perspective view showing select portions of the heat exchanger of FIG. 12.
Figure 12:
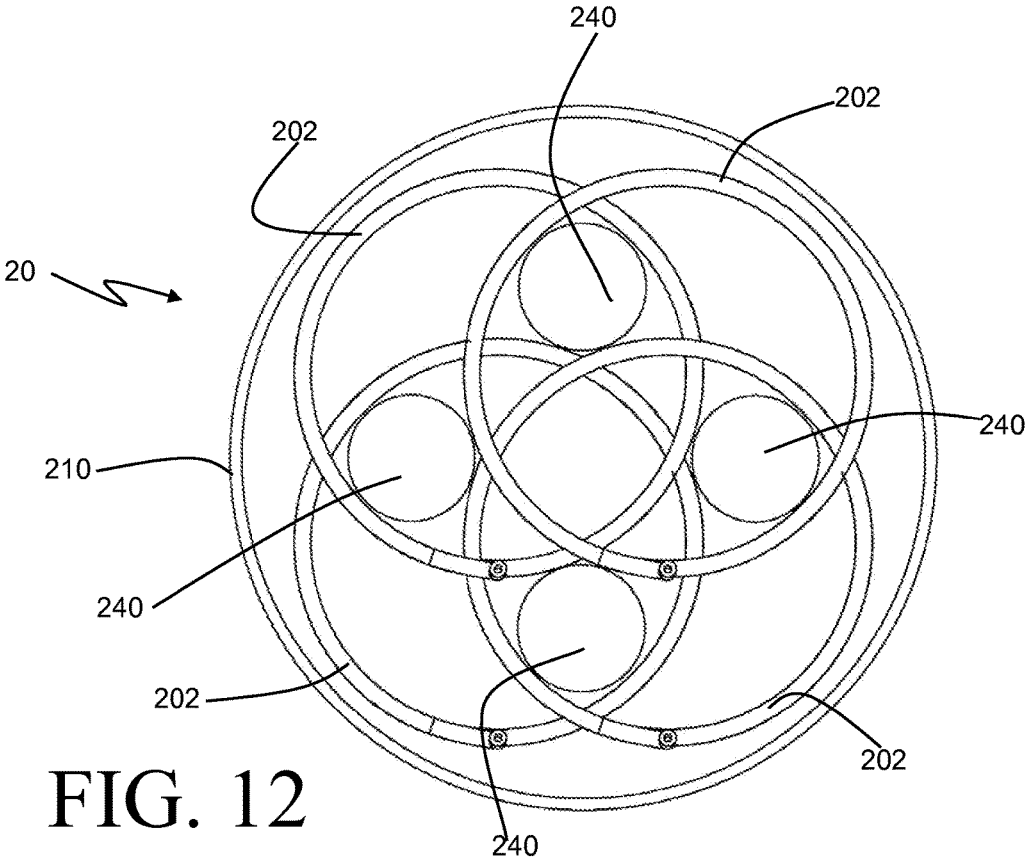
FIG. 12 is a plan view showing portions of a heat exchanger according to another embodiment of the invention.

An alternative embodiment of a heat exchanger 201 according to the present invention is depicted in FIGS. 12 and 13. The heat exchanger 201 again uses helically wound flow conduits 202, but avoids the use of corrugated fin structures. An advantage of such a design can be found in reduced manufacturing complexity and material costs, although at the expense of reduced heat transfer per unit volume resulting from the lack of extended heat transfer surfaces for the hot gas. In contrast to the embodiment of FIGS. 4-7, the flow conduits 202 of the heat exchanger 201 are displaced relative to one another such that no two of the helix axes are coincident. As best seen in FIG. 12, the fluid conduits 202 can be arranged to fill the inner volume of a casing cylinder 210 (similar to the casing cylinder 110 of the previously described embodiment). Such an arrangement exposes essentially the entirety of the outer surface of the fluid conduits 202 to the gas flow passing through the heat exchanger 201, and provides a plurality of flow channels for the hot gas between the overlapping coils of the fluid conduits 202. Rods 240 extend through the helical coils in order to maintain the relative arrangement of the fluid conduits 202. Each such rod 240 is located internally of two of the helixes defined by fluid conduits 202 and externally of the other two of the helixes, so that the positioning of the four fluid conduits 202 is maintained. While the exemplary embodiment of FIGS. 12 and 13 has four fluid conduits 202, it should be understood that more or fewer such conduits can be provided. In general, when rods 240 are present, the rods 240 are preferably arranged so that each rod 240 is located interior to at least two of the helices and exterior to at least one of the helices.

The outer casing 210 of the heat exchanger 201 can in general be of a similar design to the outer casing 110 of the heat exchanger 101, including for example diffusers 114 and fluid connections 130. The lack of corrugated fin structures within the heat exchanger 201 avoids the need to create internal braze joints other than the joints between the ends of the fluid conduits 202 and the fluid connections 130. This allows for the entire fluid conduits 202 to be compliant, enabling a structurally robust design.

Figure 6:
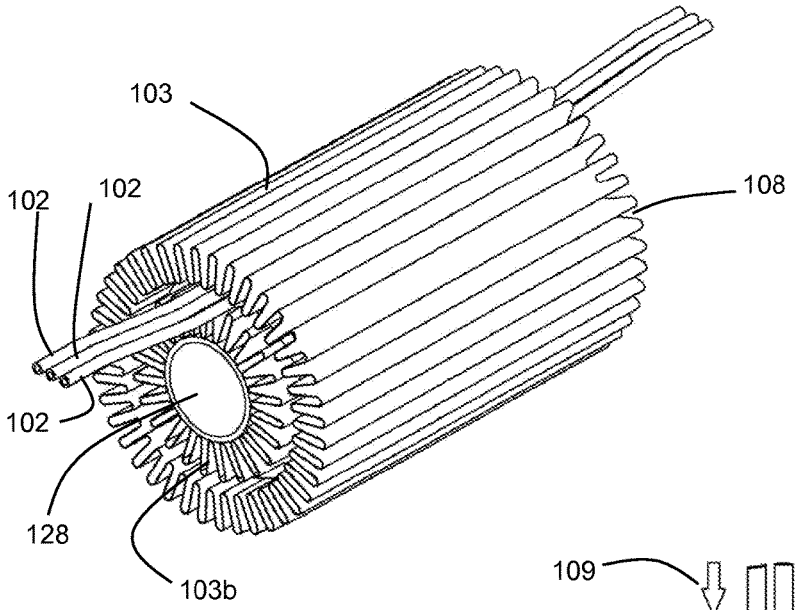
FIG. 6 is another perspective view showing select portions of the heat exchanger of FIG. 5.
Figure 14:
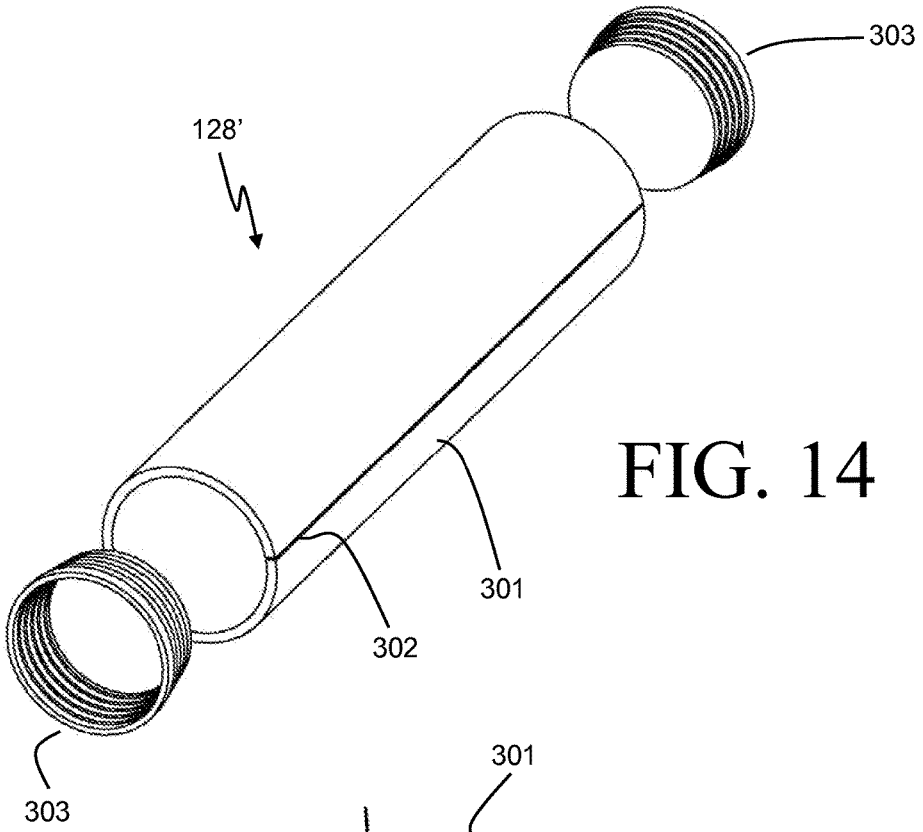
FIG. 14 is an exploded perspective view of components to be used in some embodiments of the heat exchanger of FIG. 5.
Figure 15:
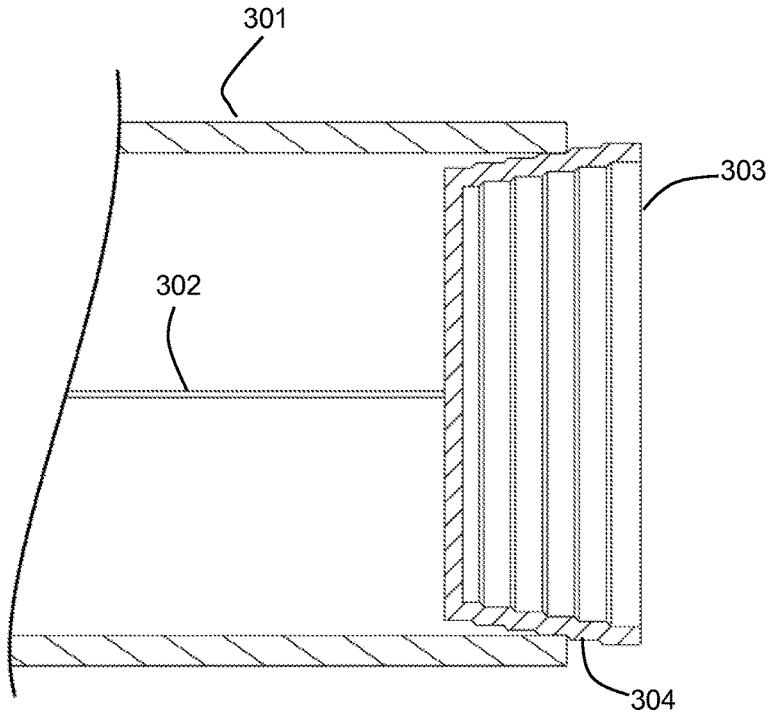
FIG. 15 is a partial section view of the components of FIG. 14.

An alternative construction for the central core 128 of the embodiment of FIGS. 4-6 is depicted in FIGS. 14-15, and is identified as 128'. As shown in the exploded perspective view of FIG. 14, the central core 128' includes a metallic sleeve 301 having a generally cylindrical form, with both ends of the sleeve 301 being open. A slit 302 extends longitudinally along the length of the sleeve 301. By way of example, the sleeve 301 and slit 302 could be formed by sawing or otherwise slitting a tube, or by forming a flat sheet into a cylindrical form without joining the free edges, thereby resulting in the formation of the slit 302. Preferably the outer diameter of the sleeve 301 is slightly less than the inner diameter formed by the troughs of the corrugated fin structure 103*b*, so that the sleeve 301 is easily inserted into the central portion of the heat exchanger during assembly.

Once the sleeve 301 has been so inserted, end caps 303 are inserted into the open ends of the sleeve 301 to diametrically expand the sleeve 301. This diametrical expansion disposes the core 128' against the troughs of the corrugated fin structure 103*b*, thereby ensuring good contact between surfaces to be brazed. The end caps 303 can be provided with a series of ramped steps 304 along their periphery, as best seen in the partial cross-sectional view of FIG. 15. As the end caps 303 are inserted, the ramped steps 304 progressively expand the slit sleeve 301 in the radial direction. Friction between the inwardly facing surface of the sleeve 301 and the steps 304 can ensure that the end caps 303 are retained within the sleeve 301 during the brazing process.

In some embodiments, the ramped steps 304 can be replace with a continuous cone-shaped surface having an angle that is sufficiently small so as to allow for retention of the end caps 303 by frictional forces. Alternatively, or in addition, the positioning of the end caps 303 can be maintained through the use of one or more mechanical fasteners. By way of example, a bolt can be inserted through holes provided in each of the end caps 303 and a nut can be fastened to a threaded end of the bolt to maintain the positioning of the end caps after insertion. In some such embodiments the bolt can be constructed of a material having a lower thermal coefficient of expansion than the sleeve so that the end caps are drawn further into the sleeve during the brazing process, thereby further expanding the sleeve to ensure that contact is maintained between parts to be joined. In other alternative embodiments, the end caps can be designed to extend over a substantial portion of the length of the sleeve 301 and can be provided with ramped surfaces that engage and function as a wedge to enlarge the sleeve 301 in the radial direction.

Various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention.

We claim:

1. A method of making a heat exchanger, comprising:

arranging a plurality of flow conduits interior to a heat exchanger casing;

extending an end of each of the plurality of flow conduits through an aperture within a wall of the casing;

inserting said ends into a connector body; and in a common brazing operation, joining the plurality of flow conduits to the connector body and joining the connector body to the casing.

2. The method of claim 1, wherein the common brazing operation seals the aperture to prevent a leak path therethrough between the interior of the casing and the exterior of the casing.

3. The method of claim 1, further comprising placing braze paste into a braze alloy chamber of the connector body prior to the common brazing operation.

4. The method of claim 3, further comprising:

performing a leak test on the joints between the plurality of flow conduits and the connector body; and placing additional braze paste into the braze alloy chamber and re-brazing the heat exchanger if the leak test indicates the presence of a leak path.

5. The method of claim 4, further comprising permanently sealing an opening of the braze alloy chamber if the leak test indicates the absence of a leak path.

6. The method of claim 1 wherein the casing is in multiple parts, said multiple parts being joined together in the common brazing operation.

7. The method of claim 1, further comprising arranging a first and second corrugated fin structure interior to the heat exchanger casing, wherein the plurality of fluid conduits are at least partially joined to the first and second corrugated fin structures in the common brazing operation.

8. The method of claim 7, further comprising:

arranging a first metallic shim between the plurality of fluid conduits and the first corrugated fin structure; and arranging a second metallic shim between the plurality of fluid conduits and the second corrugated fin structure, wherein the plurality of fluid conduits are at least partially joined to the first corrugated fin structure through the first metallic shim and the plurality of fluid conduits are at least partially joined to the second corrugated fin structure through the second metallic shim.

9. The method of claim 7, further comprising:

arranging a generally cylindrical sleeve interior to the heat exchanger casing; and inserting first and second end caps into opposing open ends of the generally cylindrical sleeve to diametrically expand the sleeve into contact with one of the first and second corrugated fin structures prior to the common brazing operation.

* * * * *